US009166351B1

(12) United States Patent
Wang et al.

(10) Patent No.: US 9,166,351 B1
(45) Date of Patent: Oct. 20, 2015

(54) POWER ADAPTING DEVICE

(71) Applicants: Tongt-Huei Wang, New Taipei (TW); Rosalia Kennedy, Concord, CA (US)

(72) Inventors: Tongt-Huei Wang, New Taipei (TW); Rosalia Kennedy, Concord, CA (US)

(73) Assignees: Tongt-Huei Wang, Concord, CA (US); Rosalia Kennedy, Concord, CA (US)

( * ) Notice: Subject to any disclaimer, the term of this patent is extended or adjusted under 35 U.S.C. 154(b) by 5 days.

(21) Appl. No.: 14/292,079

(22) Filed: May 30, 2014

(51) Int. Cl.
*H01R 27/00* (2006.01)

(52) U.S. Cl.
CPC ..... *H01R 27/00* (2013.01)

(58) Field of Classification Search
CPC ..... H01R 31/06; H01R 27/00
USPC ..... 439/171–173
See application file for complete search history.

(56) References Cited

U.S. PATENT DOCUMENTS 4,787,857 A * 11/1988 Kretchmar et al. ..... 439/189
4,973,827 A * 11/1990 Nozaki ..... 219/521
5,613,863 A * 3/1997 Klaus et al. ..... 439/131
5,616,051 A * 4/1997 Rogers et al. ..... 439/518
5,634,806 A * 6/1997 Hahn ..... 439/173
5,684,689 A * 11/1997 Hahn ..... 363/146
5,848,907 A * 12/1998 Chen ..... 439/172
5,934,921 A * 8/1999 Doong ..... 439/172
5,973,948 A * 10/1999 Hahn et al. ..... 363/146
6,039,608 A * 3/2000 Amero et al. ..... 439/651
6,109,977 A * 8/2000 Baxter et al. ..... 439/693
6,227,888 B1 * 5/2001 Hahn ..... 439/173
6,261,109 B1 * 7/2001 Liu et al. ..... 439/131
6,320,353 B1 * 11/2001 Chiu et al. ..... 320/111
6,328,581 B1 * 12/2001 Lee et al. ..... 439/106
6,364,716 B1 * 4/2002 Seo ..... 439/640
6,371,815 B1 * 4/2002 Wetzel et al. ..... 439/651
6,544,051 B1 * 4/2003 Su ..... 439/131
6,544,058 B1 * 4/2003 Chang ..... 439/173
6,592,386 B2 * 7/2003 Teng et al. ..... 439/172
6,638,113 B2 * 10/2003 Kajiwara et al. ..... 439/651
6,669,495 B2 * 12/2003 Philips et al. ..... 439/170
6,845,023 B2 * 1/2005 Philips et al. ..... 363/132
6,884,125 B2 * 4/2005 Chen ..... 439/848
7,008,246 B2 * 3/2006 Zhuge ..... 439/173
7,118,399 B1 * 10/2006 Wen et al. ..... 439/166
7,168,968 B1 * 1/2007 Li ..... 439/172
7,168,969 B1 * 1/2007 Wang ..... 439/173
7,179,105 B1 * 2/2007 Hung ..... 439/172
7,223,126 B2 * 5/2007 Ng ..... 439/651
7,232,322 B1 * 6/2007 Yen et al. ..... 439/222
7,264,492 B2 * 9/2007 Liang ..... 439/171
7,265,517 B2 * 9/2007 Bumiller ..... 320/114
7,300,297 B1 * 11/2007 Wang ..... 439/173
7,354,286 B1 * 4/2008 Lee ..... 439/172
7,439,709 B2 * 10/2008 Bumiller ..... 320/114
7,547,219 B2 * 6/2009 Zhuge ..... 439/173

(Continued)

*Primary Examiner* — Ross Gushi

(57) ABSTRACT

A power adapting device has a connecting seat, at least two conductive strips, and an adapter. The connecting seat has a mounting portion with two slots. The at least two conductive strips are mounted in the connecting seat. Each of the at least two conductive strips has a positioning sheet, a conductive sheet obliquely protruding upward from the positioning sheet, an arced sheet protruding down from the positioning sheet, and an engaging sheet protruding down from the arced sheet. The engaging sheet has a semispherical contact. The adapter is electrically connected to the conductive sheets of the at least two conductive strips. With different power adapting devices of different standards using in cooperation with a charger, the charger can comply with different electrical socket standards via the power adapting devices.

5 Claims, 6 Drawing Sheets

(56) References Cited

U.S. PATENT DOCUMENTS

| | | | | |
|---|---|---|---|---|
| 7,563,115 | B2 * | 7/2009 | van gen Hassend et al. | 439/171 |
| 7,601,023 | B1 * | 10/2009 | Ma et al. | 439/518 |
| 7,621,765 | B1 * | 11/2009 | Wu | 439/173 |
| 7,632,119 | B1 * | 12/2009 | Ma et al. | 439/172 |
| 7,632,137 | B1 * | 12/2009 | Ma et al. | 439/518 |
| 7,638,968 | B2 * | 12/2009 | Inoue et al. | 320/107 |
| 7,654,838 | B1 * | 2/2010 | Zhuge | 439/173 |
| 7,753,721 | B1 * | 7/2010 | Wu | 439/518 |
| 7,794,251 | B2 * | 9/2010 | Wen et al. | 439/173 |
| 7,798,825 | B1 * | 9/2010 | Pai | 439/131 |
| 7,874,853 | B2 * | 1/2011 | Chiang et al. | 439/173 |
| 7,896,663 | B2 * | 3/2011 | Niidome et al. | 439/131 |
| 7,946,868 | B1 * | 5/2011 | Chen | 439/173 |
| 7,946,884 | B2 * | 5/2011 | Chiang et al. | 439/518 |
| 7,985,083 | B2 * | 7/2011 | Hopwood et al. | 439/134 |
| 8,011,975 | B1 * | 9/2011 | Kim et al. | 439/680 |
| 8,033,847 | B1 * | 10/2011 | Chen | 439/172 |
| 8,052,441 | B2 * | 11/2011 | Senatori et al. | 439/171 |
| 8,079,877 | B1 * | 12/2011 | Lai et al. | 439/655 |
| 8,087,946 | B2 * | 1/2012 | Namiki et al. | 439/173 |
| 8,152,570 | B2 * | 4/2012 | Kim et al. | 439/680 |
| 8,197,265 | B1 * | 6/2012 | Lee et al. | 439/105 |
| 8,215,976 | B2 * | 7/2012 | Peng et al. | 439/345 |
| 8,226,424 | B1 * | 7/2012 | Wang et al. | 439/172 |
| 8,251,718 | B2 * | 8/2012 | Chen et al. | 439/131 |
| 8,267,705 | B2 * | 9/2012 | Huang | 439/171 |
| 8,277,234 | B2 * | 10/2012 | Hopwood et al. | 439/131 |
| 8,382,493 | B2 * | 2/2013 | Ruffner | 439/105 |
| 8,382,526 | B2 * | 2/2013 | Chen et al. | 439/655 |
| 8,465,307 | B2 * | 6/2013 | Shieh et al. | 439/173 |
| 8,512,056 | B2 * | 8/2013 | Wen et al. | 439/172 |
| 8,556,642 | B2 * | 10/2013 | Lai et al. | 439/172 |
| 8,579,656 | B2 * | 11/2013 | Huang | 439/518 |
| 8,641,459 | B1 * | 2/2014 | Matsuoka et al. | 439/777 |
| 8,651,879 | B2 * | 2/2014 | Stiehl et al. | 439/76.1 |
| 8,708,722 | B1 * | 4/2014 | Walliser et al. | 439/172 |
| 8,753,149 | B2 * | 6/2014 | Lee | 439/653 |
| 8,790,124 | B2 * | 7/2014 | Lee et al. | 439/131 |
| 8,811,051 | B2 * | 8/2014 | Chan et al. | 363/146 |
| 8,888,513 | B2 * | 11/2014 | Shi et al. | 439/131 |
| 8,936,490 | B2 * | 1/2015 | Hsu | 439/655 |
| 8,944,845 | B2 * | 2/2015 | Yu et al. | 439/518 |
| 8,944,857 | B2 * | 2/2015 | Mariano et al. | 439/695 |
| 9,054,472 | B2 * | 6/2015 | Chen | 1/1 |
| 9,077,093 | B1 * | 7/2015 | Roy et al. | 1/1 |
| 2002/0081906 | A1 * | 6/2002 | Kajiwara et al. | 439/651 |
| 2002/0127918 | A1 * | 9/2002 | Kajiwara et al. | 439/651 |
| 2003/0068909 | A1 * | 4/2003 | Su | 439/131 |
| 2003/0211767 | A1 * | 11/2003 | Philips et al. | 439/170 |
| 2003/0228778 | A1 * | 12/2003 | Shang | 439/172 |
| 2004/0097114 | A1 * | 5/2004 | Shiroshita et al. | 439/174 |
| 2004/0132328 | A1 * | 7/2004 | Wu | 439/172 |
| 2004/0253854 | A1 * | 12/2004 | Lee et al. | 439/106 |
| 2005/0136717 | A1 * | 6/2005 | Lai | 439/170 |
| 2005/0176281 | A1 * | 8/2005 | Zhuge | 439/173 |
| 2007/0032109 | A1 * | 2/2007 | Hung | 439/172 |
| 2007/0238341 | A1 * | 10/2007 | So | 439/172 |
| 2009/0117765 | A1 * | 5/2009 | Wen et al. | 439/166 |
| 2009/0163080 | A1 * | 6/2009 | Peng | 439/628 |
| 2010/0062652 | A1 * | 3/2010 | Liu | 439/660 |
| 2010/0120278 | A1 * | 5/2010 | Yang | 439/171 |
| 2010/0173526 | A1 * | 7/2010 | Chiang et al. | 439/620.1 |
| 2010/0190364 | A1 * | 7/2010 | Niidome et al. | 439/131 |
| 2011/0143560 | A1 * | 6/2011 | Lee et al. | 439/108 |
| 2011/0300754 | A1 * | 12/2011 | Kim et al. | 439/620.21 |
| 2012/0021653 | A1 * | 1/2012 | Chen et al. | 439/655 |
| 2012/0289073 | A1 * | 11/2012 | Wu et al. | 439/218 |
| 2013/0157483 | A1 * | 6/2013 | Yu et al. | 439/131 |
| 2013/0288493 | A1 * | 10/2013 | Shi et al. | 439/131 |
| 2014/0073200 | A1 * | 3/2014 | Chou et al. | 439/692 |
| 2015/0194778 | A1 * | 7/2015 | Shiroshita et al. | 1/1 |

* cited by examiner

POWER ADAPTING DEVICE

BACKGROUND OF THE INVENTION

1. Field of the Invention

The present invention relates to a power adapting device, especially to a power adapting device for a charger, such that the charger can comply with different electrical socket standards.

2. Description of the Prior Art(s)

In recent years, usage of consumer electronic products, such as smart phones, tablet computers, portable listening devices, and the like, has been greatly increased. Since the electronic product is continuously used for a long time in everyday life and consumes much electric power, a user of the electronic product would carry a charger along with him so as to recharge the electronic product whenever needed. The charger has multiple power input pins and multiple power output pins. The power input pins are inserted in an electrical socket. The power output pins are electrically connected to the electronic product. Thus, the electronic product is charged through the charger. However, the electrical sockets differ by countries, and so do the power input pins of the charger. For example, a charger with American standard power input pins is unable to be fitted in a European standard socket or a United Kingdom (UK) standard socket. Therefore, whenever a business traveler goes on the trip abroad and wants to charge the electronic products carried with him, the business traveler has to prepare a charger that has power input pins fitting in the specific socket of the country, and preparing different chargers for different country is troublesome.

To overcome the shortcomings, the present invention provides a power adapter to mitigate or obviate the aforementioned problems.

SUMMARY OF THE INVENTION

The main objective of the present invention is to provide a power adapting device. The power adapting device has a connecting seat, at least two conductive strips, and an adapter. The connecting seat has a mounting portion with two slots. The at least two conductive strips are mounted in the connecting seat. Each of the at least two conductive strips has a positioning sheet, a conductive sheet obliquely protruding upward from the positioning sheet, an arced sheet protruding down from the positioning sheet, and an engaging sheet protruding down from the arced sheet. The engaging sheet has a semispherical contact. The adapter is electrically connected to the conductive sheets of the at least two conductive strips.

With different power adapting devices of different standards used in cooperation with a charger, the charger can comply with different electrical socket standards via the power adapting devices.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
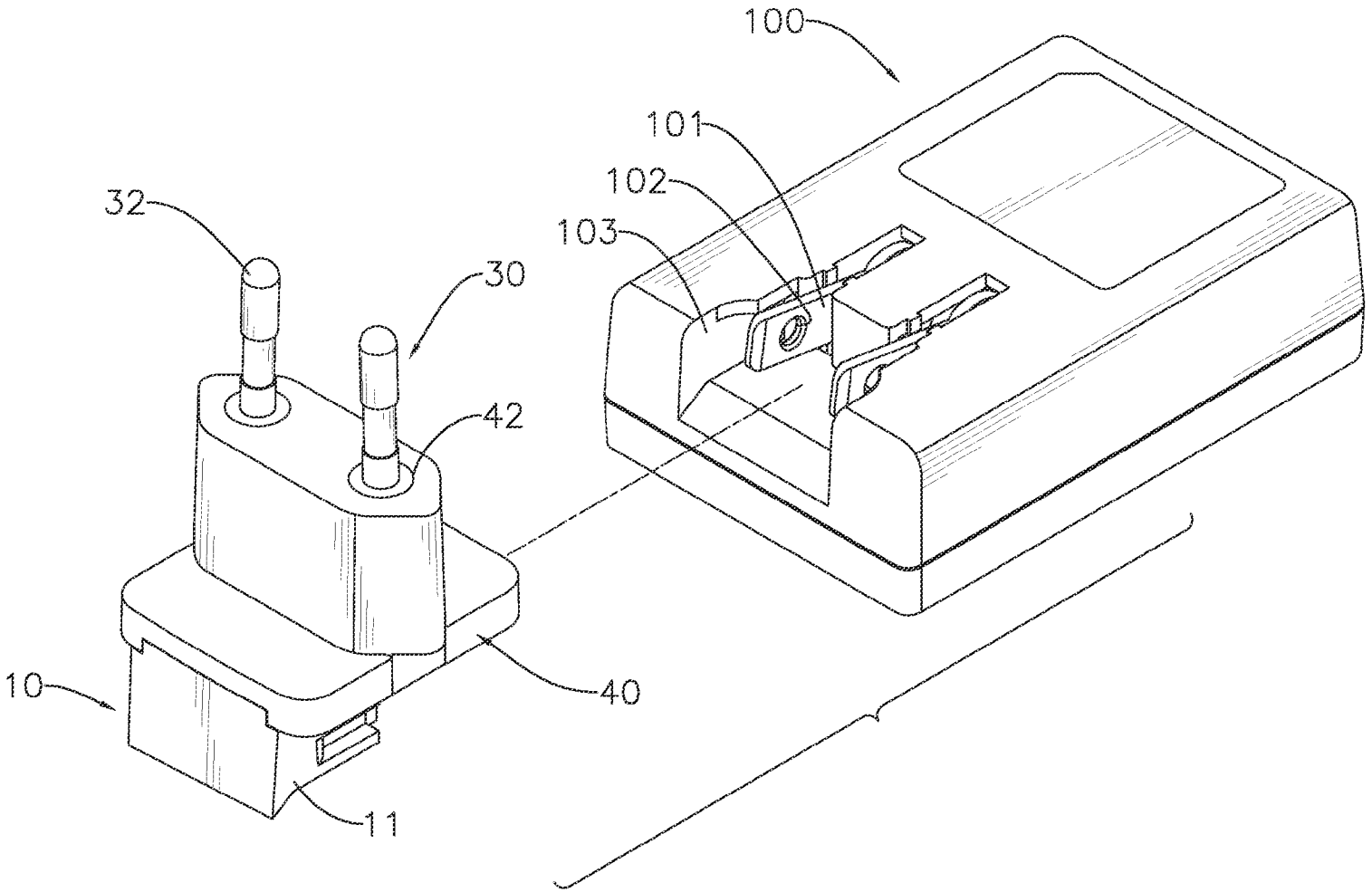
FIG. 1 is an operational exploded perspective view of a first embodiment of a power adapting device in accordance with the present invention.
Figure 2:
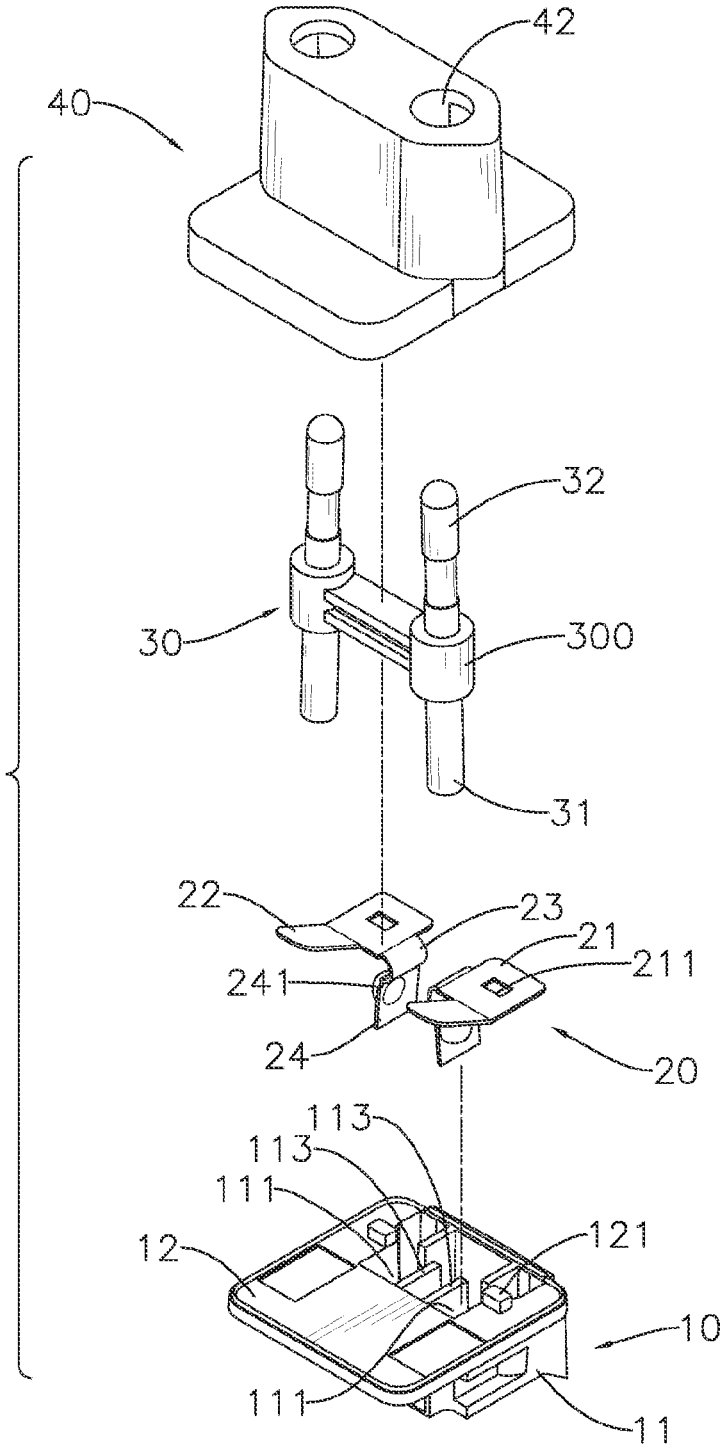
FIG. 2 is an exploded perspective view of the power adapting device in FIG. 1.
Figure 5:
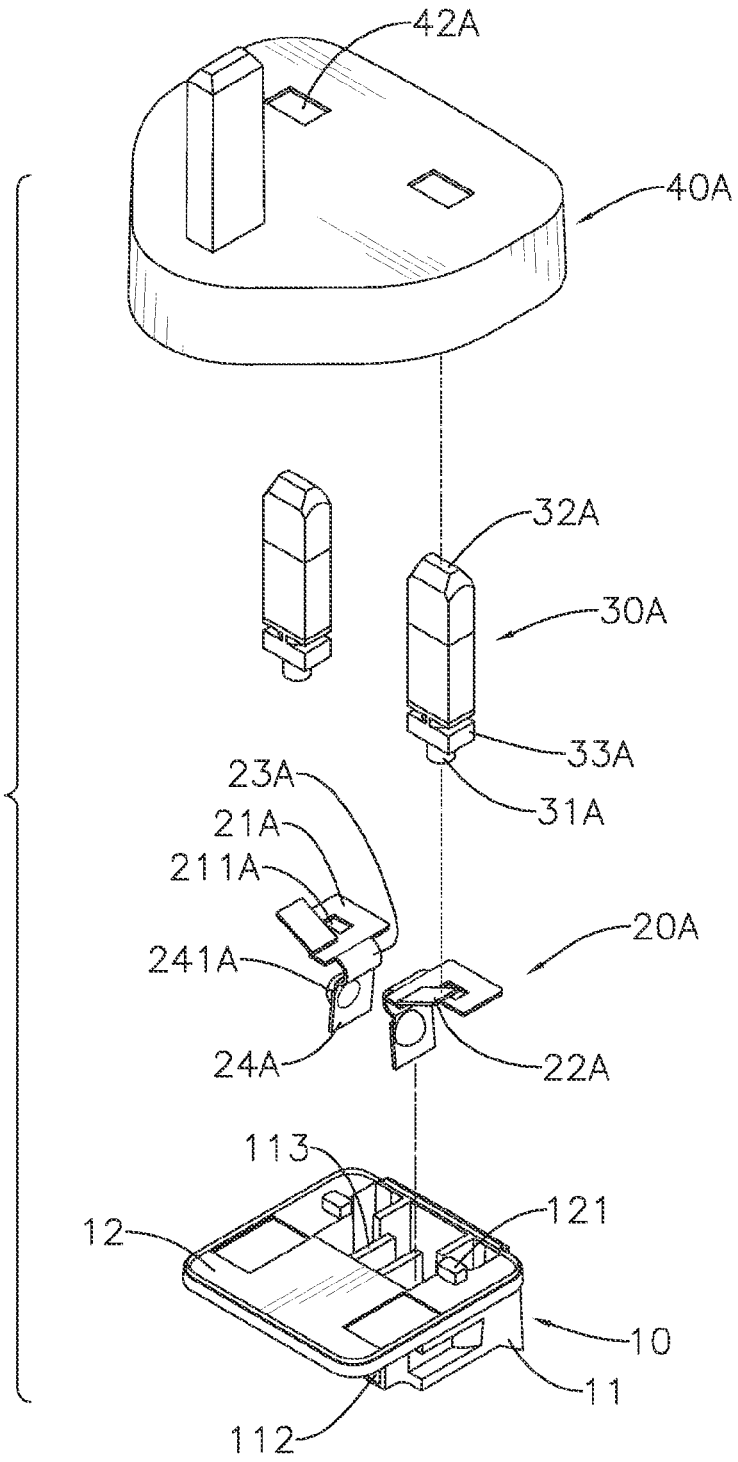
FIG. 5 is an exploded perspective view of a second embodiment of a power adapting device in accordance with the present invention.

With reference to FIGS. 1, 2, and 5, a power adapting device in accordance with the present invention comprises a connecting seat 10, at least two conductive strips 20, 20A, and an adapter.

Figure 3:
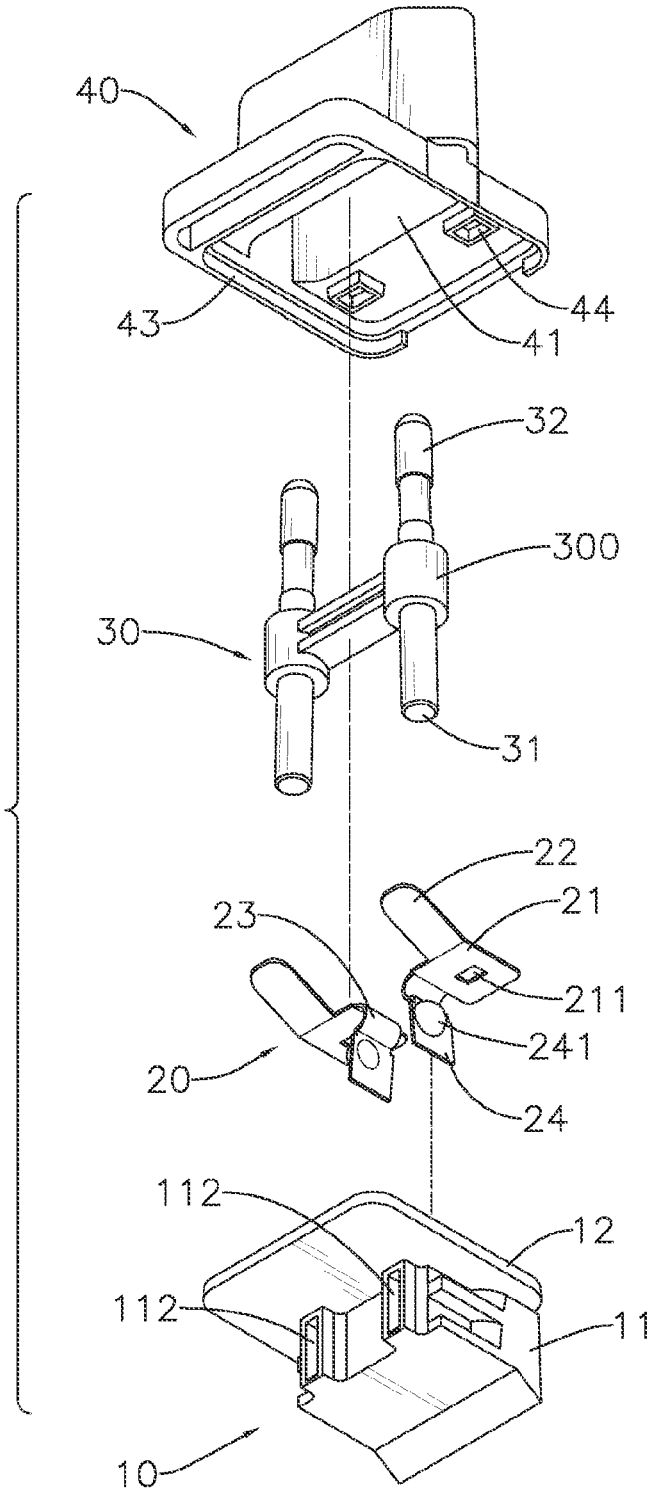
FIG. 3 is another exploded perspective view of the power adapting device in FIG. 1.

With further reference to FIG. 3, the connecting seat 10 has a mounting portion 11 and a connecting portion 12. The mounting portion 11 has a top, a sidewall, a mounting recess 111, and two slots 112. The mounting recess 111 is formed in the top of the mounting portion 11. The slots 112 are separately formed through the sidewall of the mounting portion 11 and communicate with the mounting recess 111. The connecting portion 12 is formed on the top of the mounting portion 11, is formed as a panel, and extends beyond the sidewall of the mounting portion 11. The connecting portion 12 has an upper surface and two protrusions 121. The protrusions 121 are separately formed on the upper surface of the connecting portion 12 and are oppositely disposed by the mounting recess 111 of the mounting portion 11.

Figure 4:
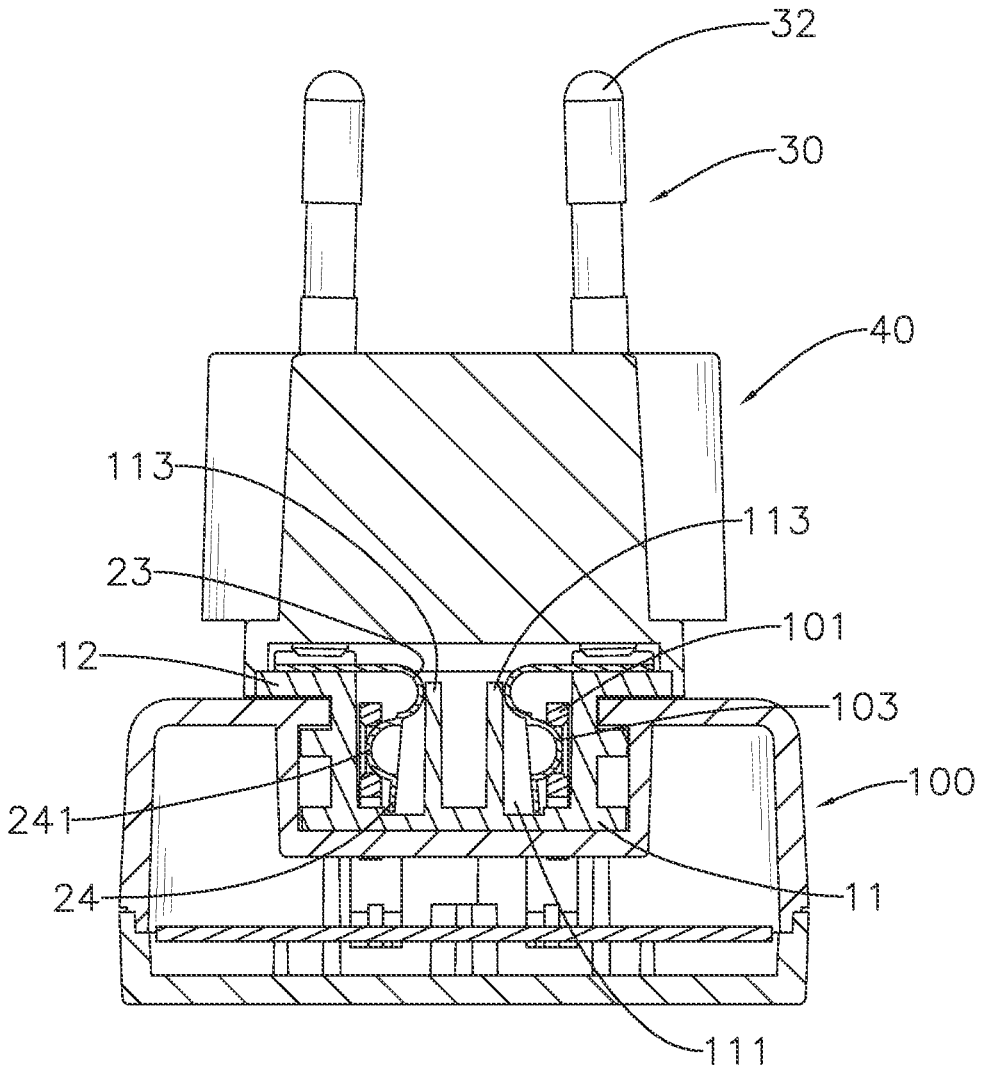
FIG. 4 is a cross-sectional rear view of the power adapting device in FIG. 1.

With further reference to FIG. 4, the at least two conductive strips 20, 20A are mounted in the connecting seat 10. Each of the at least two conductive strips 20, 20A is integrally formed as a single part and has a positioning sheet 21, 21A, a conductive sheet 22, 22A, an arced sheet 23, 23A, and an engaging sheet 24, 24A.

The positioning sheet 21, 21A is mounted on the upper surface of the connecting portion 12 and has a peripheral edge and a positioning hole 211, 211A. The positioning hole 211, 211A is formed through the positioning sheet 21, 21A and engages with a corresponding one of the protrusions 121 of the connecting portion 12 of the connecting seat 10.

The conductive sheet 22, 22A is formed on and protrudes from the peripheral edge of the positioning sheet 21, 21A, and obliquely extends upward relative to the upper surface of the connecting portion 12.

The arced sheet 23, 23A is formed on and protrudes down from the peripheral edge of the positioning sheet 21, 21A, is disposed next to the conductive sheet 22, 22A, and protrudes in the mounting recess 111 of the mounting portion 11. The arced sheet 23, 23A has a lower edge. Preferably, a curvature of the arced sheet 23, 23A can be adjusted, such that a resilience of the arced sheet 23, 23A is adjusted accordingly.

The engaging sheet 24, 24A is formed on and protrudes down from the lower edge of the arced sheet 23, 23A and has a side surface and a semispherical contact 241, 241A. The semispherical contact 241, 241A is formed on the side surface of the engaging sheet 24, 24A. Specifically, the engaging sheet 24, 24A is stamped to form the semispherical contact 241, 241A.

As shown in FIGS. 2 to 4, in a first preferred embodiment of the power adapting device, the mounting portion 11 of the connecting seat 10 further has an inner bottom and two dividing panels 113. The inner bottom of the mounting portion 11 is defined in the mounting recess 111 of the mounting portion 11. The dividing panels 113 are separately formed in the mounting recess 111 and protrude up from the inner bottom of the mounting portion 11. The dividing panels 113 divide the mounting recess 111 into an intermediate space and two side spaces. The side spaces are oppositely disposed by the intermediate space and respectively align with the slots 112. The protrusions 121 of the connecting portion 12 are respectively disposed by the side spaces of the mounting recess 111 of the mounting portion 11. The power adapting device has two conductive strips 20. The conductive strips 20 respectively protrude in the side spaces of the mounting recess 111 of the mounting portion 11 of the connecting seat 10. The conductive sheet 22 of each conductive strip 20 has a proximal edge. The arced sheet 23 and the engaging sheet 24 of each conductive strip 20 are mounted in a corresponding one of the side spaces of the mounting recess 111 of the mounting portion 11. The arced sheet 23 further has an upper edge and a convex surface. The upper edge of the arced sheet 23 is perpendicular to the proximal edge of the conductive sheet 22. The convex surface of the arced sheet 23 faces and abuts a corresponding one of the dividing panels 113 of the mounting portion 11.

As shown in FIG. 5, in a second preferred embodiment of the power adapting device, the upper edge of the arced sheet 23A of each conductive strip 20A is parallel to the proximal edge of the conductive sheet 22A of the conductive strip 20A.

With reference to FIGS. 2, 3, 5, and 6, the adapter is mounted on the connecting seat 10 and has a cap 40, 40A, 40B and two conductive prongs 30, 30A, 30B.

The cap 40, 40A, 40B is securely mounted on the connecting seat 10 and has a top portion, a bottom, a close fit recess 43, an inner top, a mounting chamber 41, two prong holes 42, 42A, 42B, and two pressing frames 44. The close fit recess 43 is formed in the bottom of the cap 40, 40A, 40B for the connecting portion 12 of the connecting seat 10 to be tightly fitted in the close fit recess 43 of the cap 40, 40A, 40B. The inner top of the cap 40, 40A, 40B is defined in the close fit recess 43. The mounting chamber 41 is formed in the bottom of the cap 40, 40A, 40B, and is formed in the inner top of the cap 40, 40A, 40B. The prong holes 42, 42A, 42B are separately formed through the top portion of the cap 40, 40A, 40B and communicate with the mounting chamber 41. The pressing frames 44 are separately formed on the inner top of the cap 40, 40A, 40B, are respectively mounted around the protrusions 121 of the connecting portion 12 of the connecting seat 10, and respectively press against the positioning sheets 21, 21A of the conductive strips 20, 20A.

With further reference to FIG. 4, the conductive prongs 30, 30A, 30B are respectively mounted through the prong holes 42, 42A, 42B of the cap 40, 40A, 40B and respectively contact the conductive sheets 22, 22A of the conductive strips 20, 20A. Each conductive prong 30, 30A, 30B has an abutting end portion 31, 31A, 31B and a protruding end portion 32, 32A, 32B. The abutting end portion 31, 31A, 31B contacts the conductive sheet 22, 22A of a corresponding one of the conductive strips 20, 20A. The protruding end portion 32, 32A, 32B is mounted through a corresponding one of the prong holes 42, 42A, 42B of the cap 40, 40A, 40B and protrudes up from the top portion of the cap 40, 40A, 40B.

As shown in FIG. 2, in the first preferred embodiment, each prong hole 42 of the cap 40 is circular. The adapter further has a connecting member 300. The connecting member 300 has two ends respectively attached securely to the conductive prongs 30.

As shown in FIG. 5, in the second preferred embodiment, each prong hole 42A of the cap 40A is triangular. Each conductive prong 30A is triangular in cross-section and further has a limit panel 33A. The limit panel 33A is formed between the abutting end portion 31A and the protruding end portion 32A of the conductive prong 30A and is mounted in the mounting chamber 41. A size of the limit panel 33A is larger than a size of the corresponding prong hole 42A of the cap 40A, such that the limit panel 33A abuts the top portion of the cap 40A and the conductive prong 30A does not drop out from the cap 40A.

Figure 6:
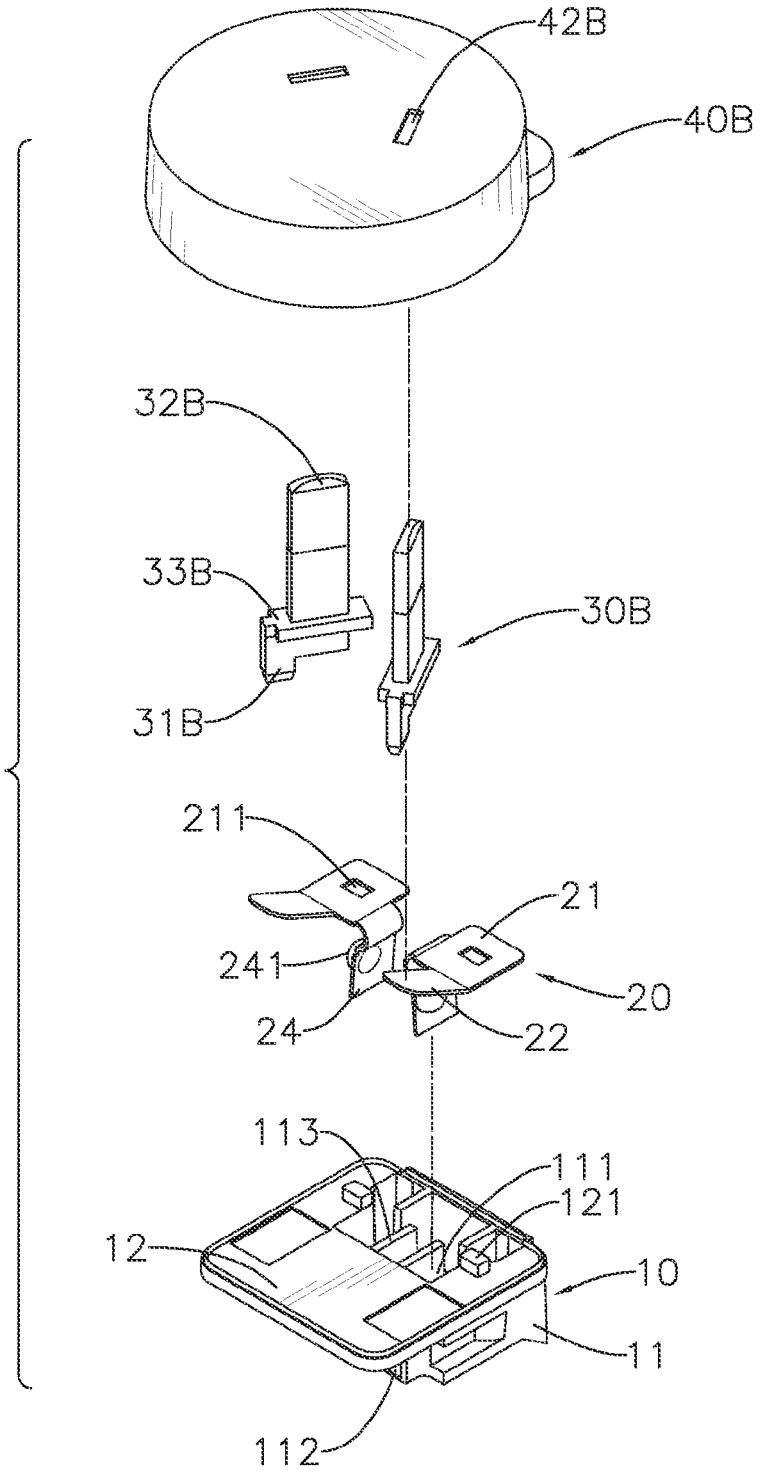
FIG. 6 is an exploded perspective view of a third embodiment of a power adapting device in accordance with the present invention.

As shown in FIG. 6, in a third preferred embodiment, each prong hole 42B of the cap 40B is elongated. Each conductive prong 30A is formed as a blade and further has a limit panel 33B. The limit panel 33B is formed between the abutting end portion 31B and the protruding end portion 32B of the conductive prong 30B and has an end edge. The end edge of the limit panel 33B is flush with a side edge of the abutting end portion 31B. A size of the limit panel 33B is larger than a size of the corresponding prong hole 42B of the cap 40B, such that the limit panel 33B abuts the top portion of the cap 40B and the conductive prong 30B does not drop out from the cap 40B.

With reference to FIGS. 1 and 4, an American standard charger 100 has an adapting recess 103 and two pins 101. The pins 101 are of American standard and are pivotally mounted in the adapting recess 103. Each pin 101 is formed as a blade, is disposed parallel to the other pin 101, and has a conducting hole 102. The pins 101 are used for being fitted in an electrical socket.

When the charger 100 is used in cooperation with the power adapting device of the present invention, the mounting portion 11 of the connecting seat 10 is mounted in the adapting recess 103 of the charger 100. The pins 101 of the charger 100 are respectively inserted into the slots 112 of the connecting seat 10 and respectively press against the engaging sheets 24, 24A of the conductive strips 20, 20A. Then, the arced sheets 23, 23A of the conductive strips 20, 20A are further arced and the semispherical contact 241, 241A of the engaging sheet 24, 24A respectively engage in the contacting holes 102 of the pins 101. Thus, the conductive strips 20, 20A of the power adapting device are electrically connected to the pins 101 of the charger 100.

Preferably, when the conducting hole on each pin is omitted, the pin becomes a Chinese standard pin and the charger becomes a Chinese standard charger. When the pins are respectively inserted into the slots 112 of the connecting seat 10 and respectively press against the engaging sheets 24, 24A of the conductive strips 20, 20A, the semispherical contact 241, 241A of the engaging sheet 24, 24A respectively abut the Chinese standard pins.

The power adapting device as described has the following advantages. The connecting seat 10 of the power adapting device is formed with modular design for mounting the conductive prongs 30, 30A, 30B of different standards. Since the power adapting device is detachable from the charger 100, when a user goes on a trip abroad, the user can replace the power adapting device on the charger 100 so as to fit sockets of a specific country and to supply electrical power to electronic products that the user carries along. Furthermore, with the arced sheet 23, 23A formed on the conductive strips 20, 20A, a clamping strength of the engaging sheet 24, 24A can be enhanced. Accordingly, elastic fatigue of the engaging sheet 24, 24A does not occur easily.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A power adapting device comprising:

a connecting seat having a mounting portion having a top;

a sidewall;

a mounting recess formed in the top of the mounting portion; and two slots separately formed through the sidewall of the mounting portion and communicating with the mounting recess; and a connecting portion formed on the top of the mounting portion, the connecting portion formed as a panel and having an upper surface;

at least two conductive strips mounted in the connecting seat, and each of the at least two conductive strips integrally formed as a single part and having a positioning sheet mounted on the upper surface of the connecting portion and having a peripheral edge;

a conductive sheet formed on and protruding from the peripheral edge of the positioning sheet;

an arced sheet formed on and protruding down from the peripheral edge of the positioning sheet, disposed next to the conductive sheet, and protruding in the mounting recess of the mounting portion, and the arced sheet having a lower edge; and an engaging sheet formed on and protruding down from the lower edge of the arced sheet and having a side surface; and a semispherical contact formed on the side surface of the engaging sheet; and an adapter mounted on the connecting seat and having a cap securely mounted on the connecting seat and having a top portion;

a bottom;

a mounting chamber formed in the bottom of the cap; and two prong holes separately formed through the top portion of the cap and communicating with the mounting chamber; and two conductive prongs respectively mounted through the prong holes of the cap and respectively contacting the conductive sheets of the conductive strips.

2. The power adapting device as claimed in claim 1, wherein the mounting portion of the connecting seat further has an inner bottom defined in the mounting recess of the mounting portion; and two dividing panels separately formed in the mounting recess and protruding up from the inner bottom of the mounting portion, the dividing panels dividing the mounting recess into an intermediate space and two side spaces, and the side spaces oppositely disposed by the intermediate space and respectively aligning with the slots.

3. The power adapting device as claimed in claim 2, wherein the connecting portion of the connecting seat further has two protrusions separately formed on the upper surface of the connecting portion and respectively disposed by the side spaces of the mounting recess of the mounting portion;

the positioning sheet of each of the at least two conductive strips further has a positioning hole formed through the positioning sheet and engaging with a corresponding one of the protrusions of the connecting portion of the connecting seat; and the arced sheet and the engaging sheet of each of the at least two conductive strips are mounted in a corresponding one of the side spaces of the mounting recess of the mounting portion, and the arced sheet further has a convex surface facing and abutting a corresponding one of the dividing panels of the mounting portion.

4. The power adapting device as claimed in claim 3, wherein the cap further has a close fit recess formed in the bottom of the cap for the connecting portion of the connecting seat to be tightly fitted in the close fit recess of the cap;

an inner top defined in the close fit recess; and two pressing frames separately formed on the inner top of the cap, respectively mounted around the protrusions of the connecting portion of the connecting seat, and respectively pressing against the positioning sheets of the conductive strips;

the mounting chamber of the cap is formed in the inner top of the cap; and each conductive prong has an abutting end portion contacting the conductive sheet of a corresponding one of the conductive strips; and a protruding end portion mounted through a corresponding one of the prong holes of the cap and protruding up from the top portion of the cap.

5. The power adapting device as claimed in claim 4, wherein the adapter further has a connecting member, and the connecting member has two ends respectively attached securely to the conductive prongs.

* * * * *